US007370909B2

(12) United States Patent
Gevaert

(10) Patent No.: US 7,370,909 B2
(45) Date of Patent: May 13, 2008

(54) FIXED SEATING ARRANGEMENT HAVING A SWING ARM SHROUD WITH A SLIDING SHIELD MEMBER

(75) Inventor: Steven C. Gevaert, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 355 days.

(21) Appl. No.: 10/866,574

(22) Filed: Jun. 12, 2004

(65) Prior Publication Data

US 2005/0274857 A1 Dec. 15, 2005

(51) Int. Cl.
*A47B 39/00* (2006.01)
*A47B 83/02* (2006.01)

(52) U.S. Cl. ..... 297/142; 297/141; 297/140; 248/188.1; 248/188.2

(58) Field of Classification Search ..... 297/140–142, 297/143, 174, 344.21, 232; 248/188.2, 188.1, 248/188.5, 188.7; 74/743.13, 473.3
See application file for complete search history.

(56) References Cited

U.S. PATENT DOCUMENTS

| | | | | |
|---|---|---|---|---|
| 1,379,263 | A | 5/1921 | Jellinek et al. | |
| 1,384,695 | A | 7/1921 | Gilarski | |
| 1,688,415 | A | 10/1928 | Fox | |
| 1,944,765 | A | 1/1934 | Sheldon | |
| 2,024,045 | A | 12/1935 | Johnson | |
| 2,782,837 | A | 2/1957 | Munsch | |
| 3,076,677 | A | 2/1963 | Kelso | |
| 3,226,154 | A | 12/1965 | Allen | |
| 3,262,733 | A | 7/1966 | Black et al. | |
| 3,486,790 | A | 12/1969 | Barecki et al. | |
| 3,535,000 | A | 10/1970 | Protzmann | |
| 3,658,379 | A * | 4/1972 | Black et al. | 297/157.1 |
| 3,709,555 | A | 1/1973 | Ostertag | |
| 3,920,276 | A | 11/1975 | Sparrow | |
| 3,951,449 | A | 4/1976 | Crowther | |
| 4,991,460 | A * | 2/1991 | Shirahama et al. | 74/523 |
| 5,251,959 | A * | 10/1993 | De Braal et al. | 297/344.1 |
| 5,326,063 | A | 7/1994 | Stevens | |
| 5,352,014 | A | 10/1994 | Allen | |
| 5,374,108 | A | 12/1994 | Saul et al. | |
| D367,772 | S | 3/1996 | Stirling et al. | |
| D379,874 | S | 6/1997 | Stirling et al. | |
| 5,683,065 | A | 11/1997 | Allen | |
| 5,791,197 | A * | 8/1998 | Rempinski et al. | 74/473.18 |
| 5,924,333 | A * | 7/1999 | Futschik et al. | 74/566 |
| 5,960,488 | A | 10/1999 | Morris | |
| 6,168,233 | B1 | 1/2001 | Markus | |
| 6,443,031 | B1 * | 9/2002 | Kim | 74/566 |
| 6,533,360 | B1 * | 3/2003 | Parkel et al. | 297/423.28 |

(Continued)

*Primary Examiner*—Amy J. Sterling
(74) *Attorney, Agent, or Firm*—Boyle Fredrickson, S.C.

(57) ABSTRACT

A protective shroud for a swing arm includes a housing made of two shroud sections that are snapped together around the base of a fixed seating arrangement. The assembled shroud includes two rectangular openings on its sides configured to allow the swing arms of the fixed seating arrangement to pivot on their axes within the shroud. The rectangular openings also include grooves on their upper and lower edges configured to receive a slidable rectangular shield member with a circular opening in its center. The rectangular shields fit over the opposed swing arms and slide within the grooves in the shroud halves as the swing arms pivot, thereby restricting access to the pinch points of the swing arms.

18 Claims, 5 Drawing Sheets

U.S. PATENT DOCUMENTS 6,923,083 B2 * 8/2005 Fujinuma ..... 74/473.33
2003/0042777 A1 3/2003 Ware et al.
2003/0115955 A1 6/2003 Keiser
2003/0216231 A1 11/2003 Reitz et al.
2004/0045487 A1 3/2004 Verkley

* cited by examiner

FIG. 3
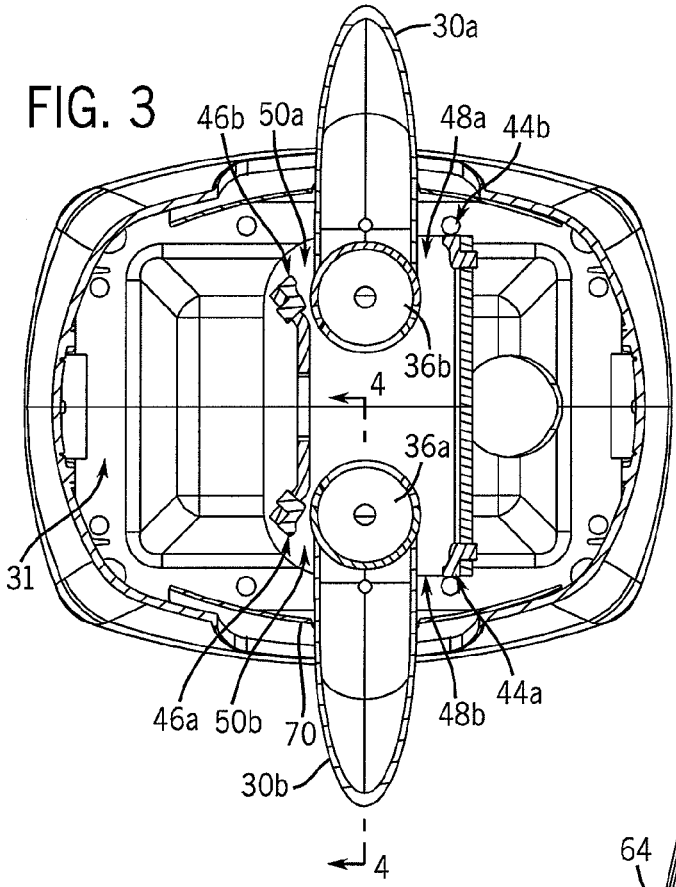
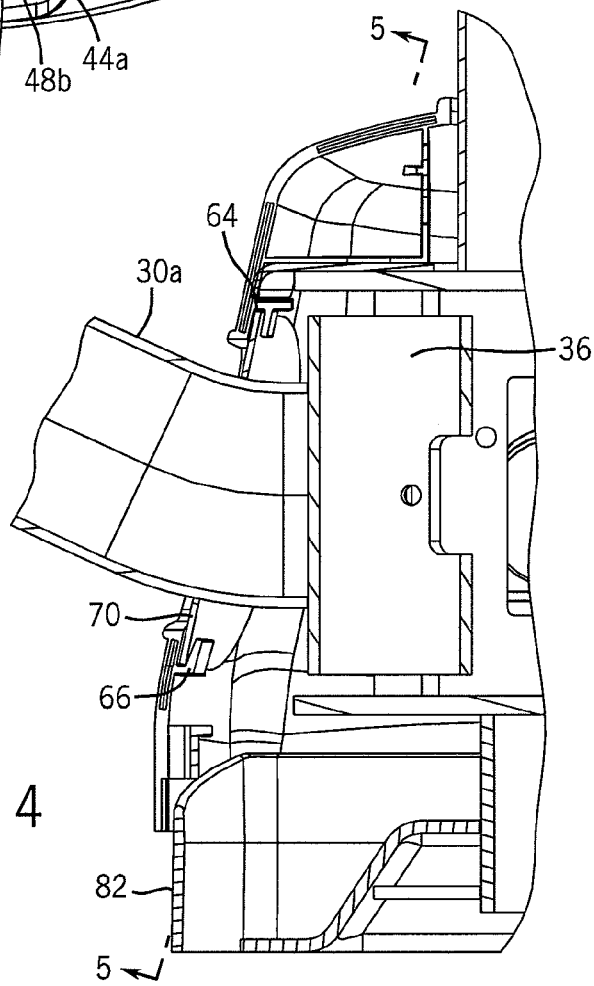
FIG. 4

FIXED SEATING ARRANGEMENT HAVING A SWING ARM SHROUD WITH A SLIDING SHIELD MEMBER

BACKGROUND AND SUMMARY OF THE INVENTION

This invention relates to fixed seating arrangements, and more particularly to a swing arm shroud with a sliding shield member for restricting access to pinch points on a swing arm assembly of a fixed seating arrangement.

Fixed seating arrangements incorporating cantilevered swing arms are a well known alternative to traditional seating arrangements. Fixed seating arrangements utilizing swing arm assemblies are commonly found in lecture halls, classrooms, laboratories, and restaurants. Examples of such fixed seating arrangements are illustrated in Protzman et al., U.S. Pat. No. 3,535,999, Barecki et al., U.S. Pat. No. 3,486,790, Ostertag, U.S. Pat. No. 3,709,555, and Allen, U.S. Pat. No. 5,683,065, the disclosures of which are hereby incorporated by reference.

Each of the noted patents discloses common design features incorporated into fixed seating arrangements utilizing swing arm assemblies. Many of these seating arrangements typically include an elongated table or counter supported by an upwardly extending pedestal. The pedestal is permanently secured to the floor via a base member. Attached to the pedestal near the base member is typically at least one laterally extending chair support arm. The support arm is attached to the pedestal, for example, by a tubular support sleeve. A pivotal connection is interposed between the sleeve and the chair support arm. The pivotal connection allows the chair to be pivoted on the cantilevered support arm within a predetermined range between a sitting position near the table and an entry or exit position away from the table. The pivotal connection, however, while beneficial in providing ease of entry and exit from a chair, creates potentially hazardous pinch points.

In response to this problem, the prior art has demonstrated numerous possible solutions. For example, Allen, U.S. Pat. No. 5,683,065, discloses a journal box and cover configured to shield portions of the connection of the cantilevered support arm and the pedestal. The journal box, however, does not completely restrict access to the pinch point and is limited to support arms that hang from a pedestal. Furthermore, the journal box does not provide an easy means to remove the box if maintenance on the assembly is required.

Protzman, U.S. Pat. No. 3,535,000, Barecki et al., U.S. Pat. No. 3,486,790 and others do not provide any additional shield members. Instead, these assemblies have attempted to alleviate the problem by providing a tight fit within the joint structure formed between the annular housing and the support flanges. This approach is unsatisfactory because, even when the fixed seating arrangement is initially installed and the joint is tightly arranged, there still exist thin pinch points capable of snagging loose clothing or paper. As the assembly undergoes additional use in the lecture hall or other area, the materials begin to wear, the joints loosen and the pinch points become more defined, thereby creating a hazard for fingers as well as clothing, books and papers. Furthermore, because the area remains exposed, it becomes prone to accumulation of dust, dirt and grease and other contaminants.

It can thus be appreciated that there is a need for an improved protective member for the pivotal connection of cantilevered swing arm seating arrangements. In view of the foregoing, it is one object to provide a shroud that restricts access to pinch points associated with swing arm assemblies while maintaining a desired maximum operative range and avoiding the problems associated with prior art fixed seating arrangements.

It is another object of the subject invention to provide a shield assembly that may be utilized in connection with any variety of fixed seating components and swing arm arrangements, and is not limited to any preferred swing arm arrangement.

A still further object of the invention is to provide a protective shroud with a sliding shield member which does not require significant modifications to existing fixed seating arrangements. Yet another object of the invention is to provide such a shroud which is effective but is relatively inexpensive to manufacture.

Consistent with the foregoing objects, the present invention contemplates a protective shroud, a shield assembly with a sliding shield member configured to restrict access to the pinch points in a swing arm assembly, and a method of restricting access to pinch points in a swing arm assembly, which are disclosed in suitable detail to enable one of ordinary skill in the art to make and use the invention.

In accordance with one aspect of the invention, a shield assembly includes a housing unit defining a base receiving region. The housing includes an opening in an upper wall, which is configured to allow a table support pedestal to extend therethrough. The housing further includes a side wall opening configured to allow lateral movement of a pivotable chair swing arm, and a shield member having edge areas that extend beyond the edges of the side wall opening. That is, the shield member is longer and wider than the side wall opening. The shield member is slidably connected to the housing, and is configured to fit around the pivotable swing arm, to restrict access into the base receiving region of the housing. The shield assembly includes upper and lower interior grooves located near the upper and lower edges, respectively, of the housing side wall opening, and which slidably retain and receive the shield member. The housing may be formed of two halves configured to attach to one another via a snap fit arrangement including opposed attachment tabs and tab receiving recesses. The shield member includes a circular opening configured to receive the pivotable swing arm therethrough, and a slot extending from the opening to allow the shield member to be positioned on the pivotable swing arm.

In accordance with another aspect of the invention, a method of restricting access to the pinch points of a swing arm assembly includes the steps of providing a shield member for a fixed seating assembly that includes a housing unit defining a table base receiving region, and an opening in an upper wall of the housing unit configured to allow a table support pedestal to extend therethrough. The housing includes a side wall opening configured to allow lateral movement of a pivotable chair support arm connected to the pedestal, and a shield member that is both longer and wider than the side wall opening, and which is configured to fit around the pivotable chair support arm. The method further includes the steps of placing the shield member over the chair support arm and placing the housing around a table base, such that the shield member engages the housing.

In accordance with another aspect of the invention, a protective shroud for a swing arm assembly includes a housing with at least one side opening for accommodating pivotable movement of a swing arm. The housing is configured to be placed over the swing arm adjacent its inner end, and includes a slidably attached shield member configured to fit around the swing arm. The shield member is configured to move within the housing when the swing arm is moved relative to the housing, and restricts access into the housing interior region from the side opening.

These, and other, aspects and objects of the present invention will be better appreciated and understood when considered in conjunction with the following description and the accompanying drawings. It should be understood, however, that the following description, while indicating a preferred embodiment of the present invention, is given by way of illustration and not of limitation. Many changes and modifications may be made within the scope of the present invention without departing from the spirit thereof, and the invention includes all such changes and modifications.

BRIEF DESCRIPTION OF THE DRAWINGS

The drawings illustrate the best mode presently contemplated for carrying out the invention. In the drawings:

FIG. 3 is a partial section view of the shroud taken along line 3-3 of FIG. 2;

FIG. 4 is a partial section view of the shroud taken along line 4-4 of FIG. 3;

DETAILED DESCRIPTION OF THE INVENTION

Figure 1:
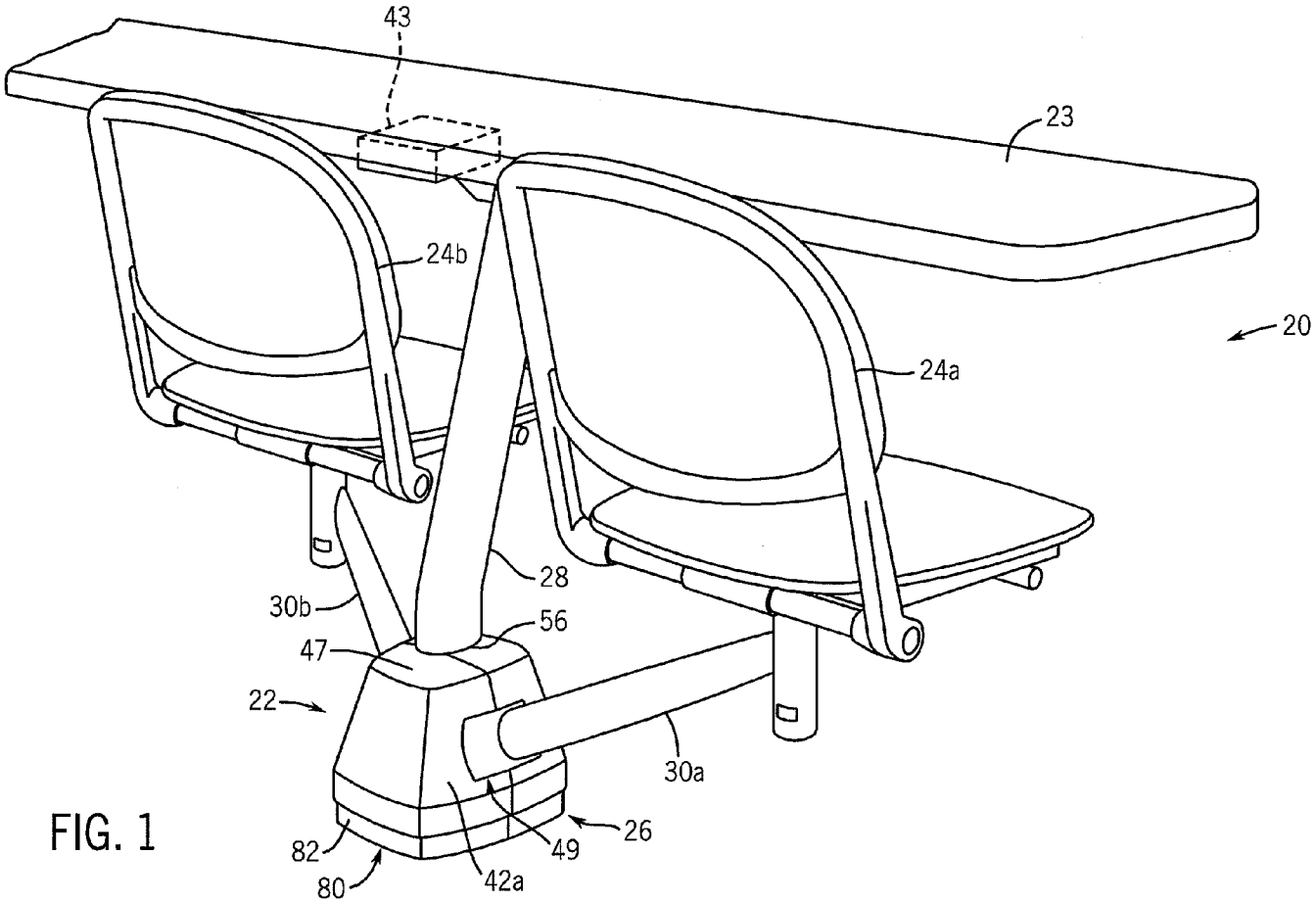
FIG. 1 is an isometric view of a fixed seating arrangement incorporating the swing arm shroud constructed according to the present invention.

In describing the preferred embodiment of the invention which as illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected" or terms similar thereto are often used. Such terms are not limited to direct connection but include connection through other elements where such connection is recognized as being equivalent by those skilled in the art.

Figure 2:
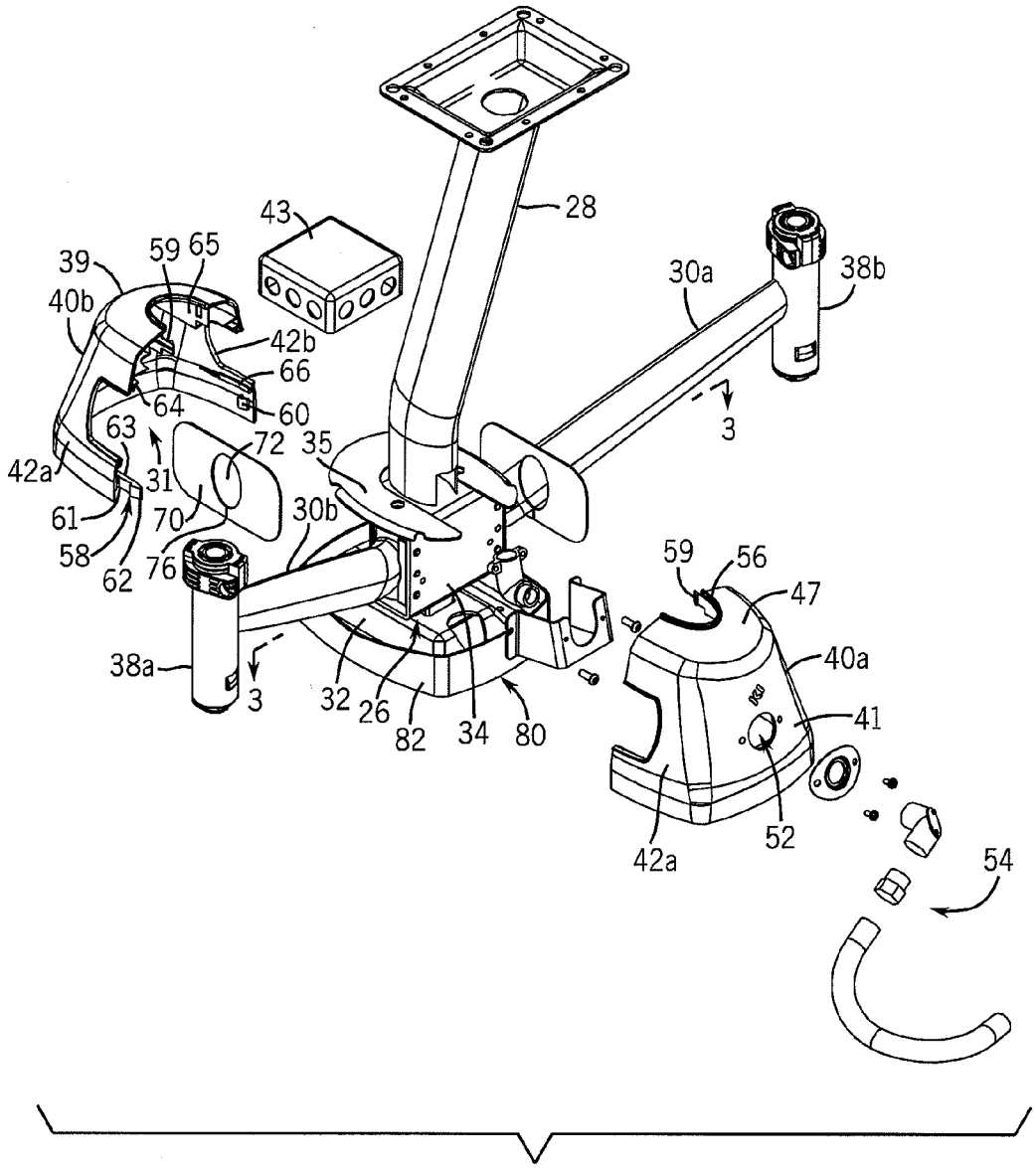
FIG. 2 is an exploded isometric view illustrating the components of the swing arm shroud incorporated in the seating arrangement illustrated in FIG. 1.

Referring to FIGS. 1 and 2, a fixed seating arrangement 20 incorporating the inventive swing arm shroud 22 of the present invention is illustrated. While the inventive aspects of the swing arm shroud 22 are applicable to a wide variety of cantilevered swing arm assemblies, for convenience and exemplary purposes only, the invention will be described with reference to the fixed seating arrangement 20 illustrated in FIG. 1. Fixed seating arrangement 20 includes a desk top 23 and chairs 24*a*, 24*b*. Desk top 22 is supported by a pedestal 28 extending upwardly from a base 26 enclosed within shroud 22. A pair of cantilevered swing arms 30*a*, 30*b* extend substantially horizontally from the base 26 and are connected to pivot members 36*a*, 36*b*. Swing arms 30*a*, 30*b* have tubular seat posts 38*a*, 38*b* extending upwardly at their distal ends. Tubular seat posts 38*a*, 38*b* provide a connection for and support chairs 24*a*, 24*b*, respectively.

As illustrated in FIGS. 2-4, base 26 includes a floor engaging structure 32, a swing arm pivot housing 34 including pivot members 36*a*, 36*b* and a shroud support bracket 35. Pivot assemblies of this type are well known in the art and can take a variety of configurations, however, in the illustrated embodiment pivot housing 34 includes swing arm front pivot stops 44*a*, 44*b* and swing arm rear pivot stops 46*a*, 46*b*. The distance between front pivot stops 44*a*, 44*b* and rear pivot stops 46*a*, 46*b* will be generally referred to as the pivot range of the swing arms 30*a*, 30*b*. The space between swing arms 30*a*, 30*b* and front pivot stops 44*a*, 44*b* define first pinch points 48*a*, 48*b* and the space between the swing arms 30*a*, 30*b* and the rear pivot stops 46*a*, 46*b* define second pinch points 50*a*, and 50*b*.

Figure 5:
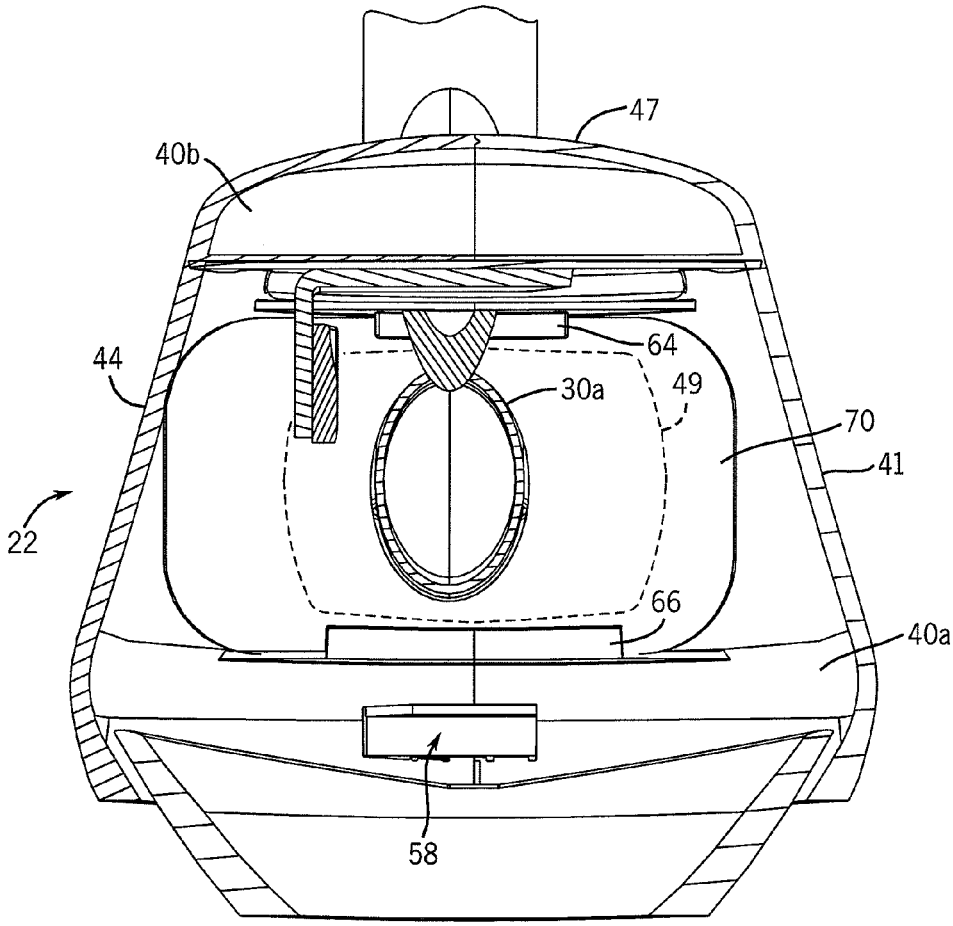
FIG. 5 is a partial section view of the shroud taken along line 5-5 of FIG. 4.

FIGS. 2, 4 and 5 illustrate the swing arm shroud 22 incorporated into the fixed seating arrangement 20 for preventing access to pinch points 48*a*, 48*b* and 50*a*, 50*b*. Shroud 22 defines a housing unit formed of two shroud halves 40*a*, 40*b*. When assembled together, shroud halves 40*a*, 40*b* define an enclosure having two trapezoidal shroud side walls, 42*a*, 42*b*, a trapezoidal shroud rear wall 39, a trapezoidal front wall 41 and a top wall 47. In the illustrated embodiment, front wall 41 defines a circular opening 52 configured to receive components of a power input assembly generally shown at 54. In a manner as is known, a box 43 may be mounted to the underside of desk top 23, for use in a power and/or data distribution system associated with fixed seating arrangement 20. Wiring associated with power input assembly 54 is interconnected with box 43, and in turn is interconnected with the power distribution system of fixed seating arrangement 20. Power input assembly 54 is an optional feature of some fixed seating arrangements, which provides outlets on the desk top 22 for laptops and other electronic devices.

It is understood that the assembled shroud 22 could take a variety of different shapes and configurations in accordance with the present invention. Shroud 22, for example, could alternatively be circular. Regardless of the desired shape, the assembled shroud 22 defines an internal base receiving region 31 large enough to receive and cover the assembled components of the seat base 26, including the swing arm pivot housing 34 and shroud support bracket 35, while substantially aligning with the base ground engaging structure 32.

Alternatively, it is understood that the inventive aspects of shroud 22 could be incorporated into fixed seating arrangements wherein the pivot housing 34 including pivot members 36*a*, 36*b* are positioned upwardly on the pedestal 28 away from the base. In such a configuration, shroud 22 covers pivot housing 34 and pivot members 36*a*, 36*b* but does not engage or cover the floor engaging base.

Still referring to FIGS. 2, 4 and 5 assembled shroud 22 includes a substantially rectangular opening 49 formed in each of side walls 42*a*, 42*b*. Rectangular opening 49 is configured to provide sufficient clearance for swing arms 30*a*, 30*b* to move the entire predetermined pivot range without any interference with the edges of opening 49. Thus, the width of the rectangular opening 49 is slightly greater than the pivot range and the height of the rectangular opening 49 is slightly greater than the vertical dimension of the swing arms 30*a*, 30*b* while further compensating for any angle of the swing arm in relation to the pedestal 28. Assembled shroud 22 also includes a circular top opening 56 configured to allow the pedestal 28 to pass therethrough. Shroud support bracket 35 provides alignment of the shroud halves 40*a*, 40*b* as the shroud halves 40*a*, 40*b* are moved together, and further provides support for shroud 22 formed by the assembled shroud halves 40*a*, 40*b*.

It is understood that shroud halves 40*a*, 40*b* could be attached in a variety of ways such as hingedly attached, or attached by fasteners. It is further understood that shroud 22 could alternatively be comprised of a single preassembled piece. In the illustrated embodiment, shroud halves 40*a*, 40*b* are attached by an engagement tab 58 engaging a retaining flange 60. As illustrated in FIG. 2, each shroud half 40*a*, 40*b* includes a semi-flexible tab 58 projecting from a lower end of side wall 42*a*. Tab 58 is comprised of a rectangular extension 61 and an angled lip 62 having a thickness greater than that of the rectangular extension 61. The difference in thickness between the angled lip 62 and the extension 61 defines a recess area 63 configured to fit around retaining flange 60 when lip 62 engages flange 60. Retaining flange 60 is a rectangular projection located on the lower end of an opposite side wall 42*b* and aligned with tab 58. Each shroud half 40*a*, 40*b* includes at least one tab 58 and one retaining flange 60, which are configured to align with an opposed tab 58 and retaining flange 60 on the opposite shroud half such that shroud halves 40*a*, 40*b* may be secured to one another via a snap-fit arrangement. In addition, each shroud half 40*a*, 40*b* further includes an upper tab 59 configured similarly to retaining tab 58, and which is adapted to engage a recess formed in an upper retaining flange 65 associated with the opposite shroud half.

Referring now to FIGS. 2-5, the assembled internal walls of the shroud 22 define an upper groove 64 and a lower groove 66 configured to slidably receive a partially flexible protective shield 70 therein. Upper 64 and lower 66 grooves are located on the interior of side walls 42*a*, 42*b* adjacent the upper and lower edges of the opening 49, respectively. Upper 64 and lower 66 grooves may extend a length slightly greater than the length of the opening 49, and provide a path for guiding sliding movement of shield 70, in a manner to be explained. Alternatively, due to the length of shield 70, grooves 64 and 66 may simply extend a partial distance near the ends of the opening, as long as such distance allows grooves 64, 66 to retain shield 70 throughout its sliding motion, as will be described below.

Shield 70 is a rectangular member with a circular opening 72 in its center configured to receive a swing arm 30*a*, 30*b* therethrough. It is desirable that shield 70 be comprised of a slightly flexible material such as a flexible thermoplastic material, to enable a shield 70 to be easily attached to each the swing arms 30*a*, 30*b* while still sliding within grooves 64, 66 and preventing access to the internal base receiving region 31. In order to adequately restrict access to pinch points 48*a*, 48*b* and 50*a*, 50*b* throughout the predetermined pivot range, while at the same time not inhibiting the motion of the swing arms, the shield 70 has a length slightly greater than rectangular opening 49 of the shroud 22. As will be described in greater detail below, shield 70 is configured to slide along grooves 64, 66 and to maintain opening 49 closed, regardless of the position of the swing arms 30*a*, 30*b*.

As noted above, shield 70 defines a circular opening 72 in its center configured to fit tightly around swing arms 30*a*, 30*b*. It is understood that the particular configuration of the opening can take a variety of shapes and is dictated by the shape of the swing arms 30*a*, 30*b*. Extending from the opening 72 on one side of the shield is a slot 76. Slot 76 allows the shield member to be bent and manipulated in order to easily install shield 70 over swing arms 30*a*, 30*b* during assembly of the shroud 22.

Figure 6:
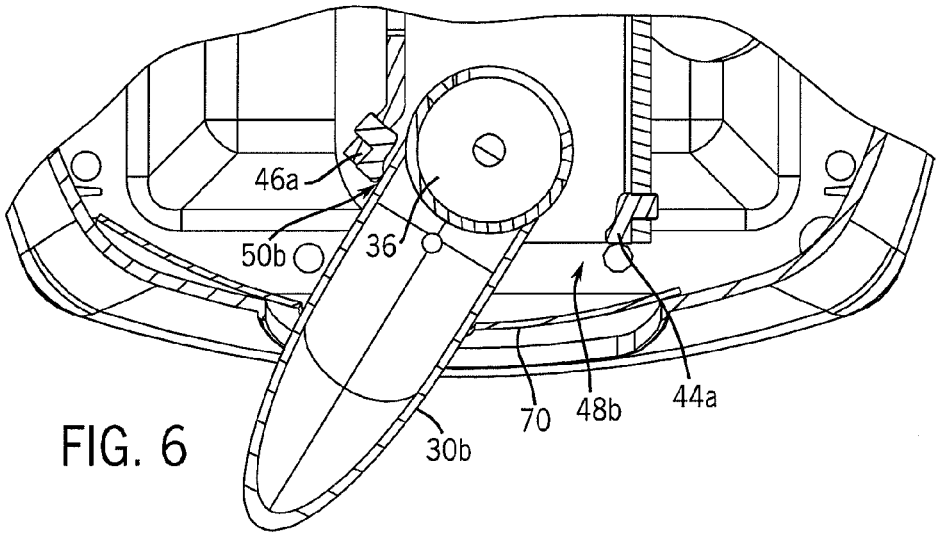
FIG. 6 is an enlarged partial section view of the of a portion of the shroud illustrated in FIG. 3, showing the swing arm and shield in a first position.
Figure 7:
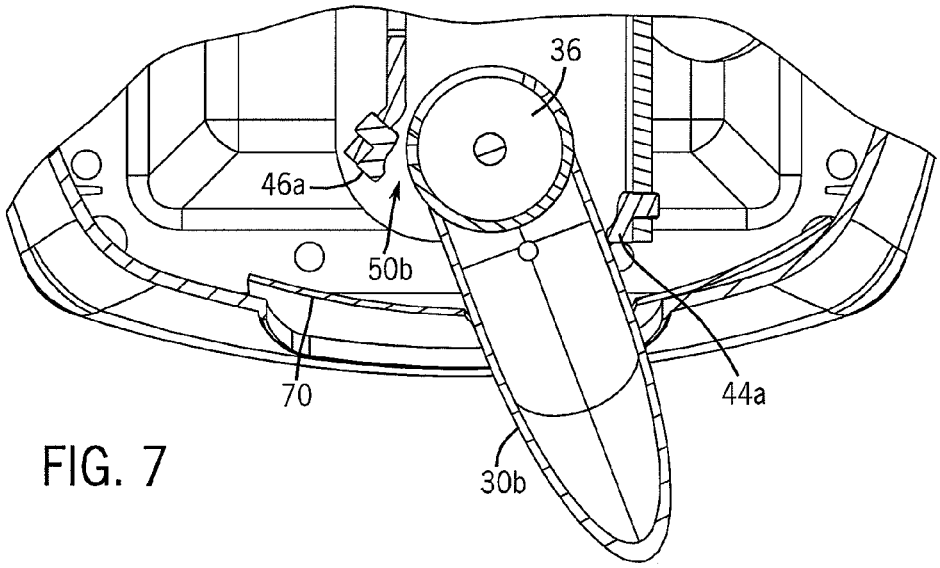
FIG. 7 is an enlarged partial section view similar to FIG. 6, showing the swing arm and shield in a second position

Turning now to FIGS. 3, 6 and 7, the motion of the shield 70 within the shroud 22 will be described. FIG. 3 illustrates the swing arms 30*a*, 30*b* in their center position, with shield 70 engaged with grooves 64, 66. Each swing arm 30*a*, 30*b* extends through rectangular opening 49 of one of shields 70. While in this position, shield 70 is essentially centered within the rectangular opening 49 and access to the internal base receiving region 31 through the opening 49 is restricted by shield 70.

FIG. 6 illustrates the swing arm 30*b* in a first rearward position. In this rearward position, swing arm 30*b* is pivoted backward, and engages swing arm rear pivot stop 46*a*. As illustrated, swing arm shield 70 has moved with swing arm 30*b* within the path defined by grooves 64, 66. Because shield 70 is longer and wider than the rectangular opening 49, despite its lateral movement within the grooves 64, 66, opening 49 remains covered by shield 70.

FIG. 7 illustrates the swing arm 30*b* in a second forward position. In the second forward position, swing arm 30*b* has pivoted forward and engages swing arm front pivot stop 44*a*. Swing arm shield 70 has moved with swing arm 30*b* within the path defined by grooves 64, 66. Because shield 70 is longer and wider than the rectangular opening 49, despite its lateral movement within the grooves 64, 66, opening 49 remains covered. Thus, as illustrated in FIGS. 3, 6 and 7, regardless of the movement of the pivot member and attached swing arm, the attached sliding shield 70 keeps the rectangular opening 49 closed, thereby preventing the possibility of interference with pinch points 48*a*, 48*b*, 50*a* and 50*b*. Furthermore, because shield 70 moves with the pivot arms, 30*a*, 30*b*, movement of the pivot arms is not restricted in any way.

In order to assemble the shroud 22 on a fixed seating arrangement 20, a user first places shields 70 over swing arms 30*a*, 30*b*. In order to position the shields 70, a user bends the shields 70 along slots 76 to create an opening that enable shields 70 to be positioned over swing arms 30*a*, 30*b*. Once in place, shields 70 are adjusted along the swing arms 30*a*, 30*b* to a position where they will align with the grooves 64, 66 of the shroud halves 40*a*, 40*b*. The shroud halves 40*a*, 40*b* are brought together around base 26 such that the halves 40*a* and 40*b* are aligned and supported on shroud support bracket 35. As the halves are brought together, the tabs 58 engage retaining flanges 60, the upper tabs 59 engage retaining flanges 65, and the shields 70 engage grooves 64, 66. The halves 40*a*, 40*b* are then snapped together and the shroud 22 is assembled.

Floor engagement structure 32 is in the form of a floor plate, which is typically welded to the lower end of pedestal 28 and is adapted to be mounted to the floor or other supporting surface. A lower skirt 80 is located below shroud 22, and is retained in position by clips (not shown) that are sandwiched between the floor and the floor plate. Skirt 80 includes an upstanding side wall 82, which extends upwardly from the floor a predetermined distance. The floor plate may be oriented at an angle relative to horizontal, to accommodate a slope in the floor to which seating arrangement 20 is mounted. Side wall 82 of skirt 80 is therefore oriented at an angle corresponding to the slope of the floor. The open lower end of shroud 22 surrounds skirt side wall 82, and is configured such that the lower edge of shroud 22 is located below the upper edge of skirt side wall 82, to provide a closed, finished appearance.

With the construction as shown and described, all of the internal components associated with the base 26 are concealed within the internal base receiving region 31 defined by the shroud 22. Thus, shroud 22 restricts access to pinch points 50*a*, 50*b*, 48*a*, 48*b* as well as provides a more finished look than prior art assemblies. Shroud 22 also serves to prevent exposure of the base components to moisture, dirt, dust or other contaminants.

While the above description is given by way of example, it is recognized that numerous other configurations could be utilized with the inventive aspects of the shroud 22 and are included in the present invention. Although the best mode contemplated by the inventor of carrying out the present invention is disclosed above, practice of the present invention is not limited thereto. As noted throughout the application, numerous alternative configurations of swing arm assemblies could be used with the shroud 22. It will be manifest that various additions, modifications and rearrangements of the features of the present invention may be made without deviating from the spirit and scope of the underlying inventive concept. Moreover, the individual components need not be formed in the disclosed shapes, or assembled in the disclosed configuration, but could be provided in a variety of shapes, and assembled in a variety of configurations.

All such alternatives, additions, modifications and rearrangements are contemplated as being within the scope of the following claims particularly pointing out and distinctly claiming the subject matter regarded as the invention.

I claim:

1. A seating arrangement, comprising:

a seat;

an arm configured to support the seat;

an arm support with which the arm is movably interconnected, wherein the arm is configured to support the seat at a location outwardly of the arm support, and wherein the arm is laterally movable relative to the arm support;

a housing defining an interior within which the arm support is located, wherein the housing includes at least one housing side wall which at least in part defines the interior, and which includes an opening configured to allow lateral movement of the arm within the opening; and a shield member that occupies the side wall opening, wherein the shield member is interconnected with the arm and is slidably engaged with the housing side wall for movement relative to the housing side wall within the opening along with the arm, wherein the shield member is configured to maintain the opening closed during movement of the arm relative to the housing to prevent access into the interior of the housing.

2. The seating arrangement of claim 1, wherein the housing defines upper and lower interior grooves located adjacent respective upper and lower edges of the housing side wall opening, wherein the grooves are configured to slidably retain and receive the shield member.

3. The seating arrangement of claim 1, wherein the housing comprises two sections configured to attach to one another.

4. The seating arrangement of claim 3, wherein the sections attach together by a snap fitting connection.

5. The seating arrangement of claim 4, wherein the snap fitting connection comprises at least one attachment tab on a first one of the sections configured to engage at least one tab retaining flange located on a second one of the sections.

6. The seating arrangement of claim 1, wherein the shield member includes an opening configured to receive the arm therethrough.

7. The seating arrangement of claim 6, wherein the shield member further includes a slot extending from the opening configured to allow the shield member to be positioned on the arm.

8. The seating arrangement of claim 6, wherein the shield member is comprised of a flexible material.

9. A protective shroud for a swing arm assembly in a seating arrangement, comprising:

a seating arrangement including a fixed seat support, a swing arm movably interconnected with the seat support for lateral movement, and a seat interconnected with the swing arm and positioned outwardly of the seat support;

a housing within which the seat support and a portion of the swing arm are located, wherein the housing includes at least one wall which at least in part defines an interior region, and at least one opening in the housing wall for allowing lateral movement of the swing arm relative to the housing; and a shield member configured to fit around the swing arm, wherein the shield member is slidably engaged with the housing and is movable relative to the opening, wherein the shield member is configured to move relative to the opening along with the swing arm and to prevent access into the housing interior region from the opening.

10. The protective shroud of claim 9, wherein the shield member is slidably engaged with the housing via interior guide structure located in the interior region of the housing adjacent spaced apart edges of the opening, wherein the interior guide structure is configured to slidably receive the shield member.

11. The protective shroud of claim 9, wherein the shield member defines an annular opening configured to receive the swing arm, and includes a slit extending therefrom for allowing the shield member to be positioned over the swing arm.

12. The protective shroud of claim 9, wherein the housing is comprised of at least two housing sections, wherein the housing sections are configured to be assembled together around the arm support.

13. The protective shroud of claim 12, wherein the housing sections are assembled together via a snap fit arrangement.

14. The protective shroud of claim 9, wherein the fixed seat support includes an upwardly extending pedestal, and wherein the housing is further configured to fit around the upwardly extending pedestal.

15. The protective shroud of claim 14, wherein the housing includes holes configured to receive an electrical conduit for providing electrical power and/or data wires to the seating arrangement.

16. The protective shroud of claim 14, wherein the fixed seat support includes a shroud support bracket configured to support the housing on the seat support.

17. The protective shroud of claim 16, wherein the housing is defined by a pair of housing sections that are assembled together onto the shroud support bracket.

18. The protective shroud of claim 14, further comprising a skirt member defining an upwardly extending wall, wherein the skirt member extends below the housing and conceals a space located between a lower end defined by the housing and a support surface to which the seat support is mounted.

* * * * *